US006113182A

United States Patent [19]

Wise

[11] Patent Number: 6,113,182

[45] Date of Patent: Sep. 5, 2000

[54] FOOTREST-TABLE CONVERTIBLE ARTICLE OF FURNITURE

[76] Inventor: James H. Wise, 2346 Patuxent River Rd., Gambrills, Md. 21054

[21] Appl. No.: 09/342,252

[22] Filed: Jun. 29, 1999

Related U.S. Application Data

[60] Provisional application No. 60/091,455, Jul. 1, 1998.

[51] Int. Cl.[7] ..... A47C 13/00

[52] U.S. Cl. ..... 297/119; 297/105; 297/423.41; 108/13

[58] Field of Search ..... 297/105, 118, 297/119, 129, 423.41, 130, 423.44, 423.46, 461, 462; 108/13

[56] References Cited

U.S. PATENT DOCUMENTS

| | | | |
|---|---|---|---|
| 3,650,562 | 3/1972 | Adler | 247/423.41 |
| 3,667,803 | 6/1972 | Ford | 297/119 |
| 4,539,977 | 9/1985 | Schneider, Sr. | 297/423.41 X |
| 5,893,182 | 4/1999 | Sutherland et al. | 297/105 X |

*Primary Examiner*—Peter R. Brown
*Attorney, Agent, or Firm*—Shoemaker & Mattare

[57] ABSTRACT

A footrest-table convertible article of furniture includes a pair of vertical supports, at least one brace rigidly interconnecting the vertical supports, a rotatable element disposed between the vertical supports, and a pivot connection supporting the rotatable element on the vertical supports for rotation about a horizontal axis. The rotatable element has two opposed major surfaces, one being a flat unupholstered table top, and another being a cushioned footrest. The rotatable element can be flipped 180° between a position in which the table top is uppermost and horizontal, and a position in which the cushioned footrest is uppermost and horizontal. A locking mechanism secures the rotatable element in either of the positions, at a consistent height above the ground.

8 Claims, 4 Drawing Sheets

FOOTREST-TABLE CONVERTIBLE ARTICLE OF FURNITURE

This application is related to provisional patent application Ser. No. 60/091,455 filed Jul. 1, 1998.

BACKGROUND OF THE INVENTION

This invention relates to an article of furniture which can easily be converted between a form which serves as a hassock, ottoman or footstool and a form having a flat table top.

Cushioned ottomans serve as a place to rest the feet while one sits on a chair or sofa. It frequently is desired to place food and beverage items on a flat top surface such as a coffee table, typically at the same spot occupied by the ottoman. A single composite or convertible article of furniture which could provide both functions would save space, and have advantages of economy and ease of use over two separate pieces of furniture.

Some prior inventors have proposed convertible furniture items serving as both a table and a footrest. See, for example, U.S. Pat. No. 3,667,803.

Prior related inventions suffer at least one of the following limitations:

- they do not provide the function of ottoman and coffee table at the same time;
- they have complicated constructions comprising springs, hooks, latches, brackets, and other hardware which tend to increase both the cost and potential for mechanical failure or wear;
- they do not produce a coffee table top at the same height as the footrest, when converted.

In the prior patent mentioned, the cushion is presented at a height greater than that of the table top, and to compensate, adjustment mechanisms have in some cases been provided.

SUMMARY OF THE INVENTION

An object of the invention is to provide a convertible article of furniture capable of performing two separate functions: that of a footrest, and that of a table.

Another object is to provide simultaneously a flat table top and a footrest.

A further object is to provide a convertible article of furniture having a minimum number of parts, thus to minimize cost and complexity, and to avoid maintenance problems.

These and other objects are attained by a footrest-table convertible article of furniture having a pair of vertical supports, at least one brace rigidly interconnecting the vertical supports, a rotatable element disposed between the vertical supports, and a pivot connection supporting the rotatable element on the vertical supports for rotation about a horizontal axis. The rotatable element has two opposed major surfaces, one being a flat unupholstered table top, and another being a cushioned footrest. The rotatable element can be flipped 180° between a position in which the table top is uppermost and horizontal, and a position in which the cushioned footrest is uppermost and horizontal. A locking mechanism secures the rotatable element in either of the positions.

The invention, by using a dowel, pivot pin, or ball joint connected for the rotation of the convertible foot rest/table top, avoids the need to store foot cushions elsewhere.

The invention, in one form, also allows one to have a foot rest and a table top available at the same time.

Another advantage of the invention is that the table top and the foot rest have substantially the same height, in contrast to prior inventions, wherein the cushioned side would be too high for comfort, or the table top too low.

The invention allows for a variety of locking mechanisms to hold the movable portion of the article in its selected configuration.

BRIEF DESCRIPTION OF THE DRAWINGS

In the accompanying drawings.

DESCRIPTION OF THE PREFERRED EMBODIMENT

Figure 1:
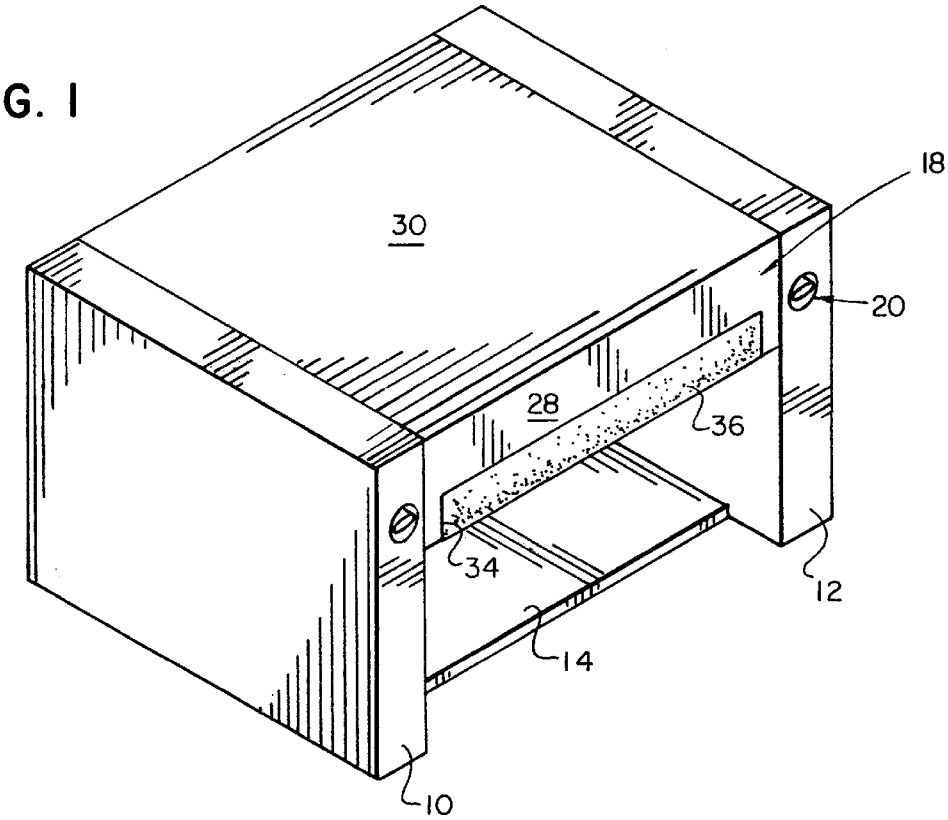
FIG. 1 is a isometric view, from the front, of a footrest-table convertible article of furniture embodying the invention, shown in its table top configuration.
Figure 4:
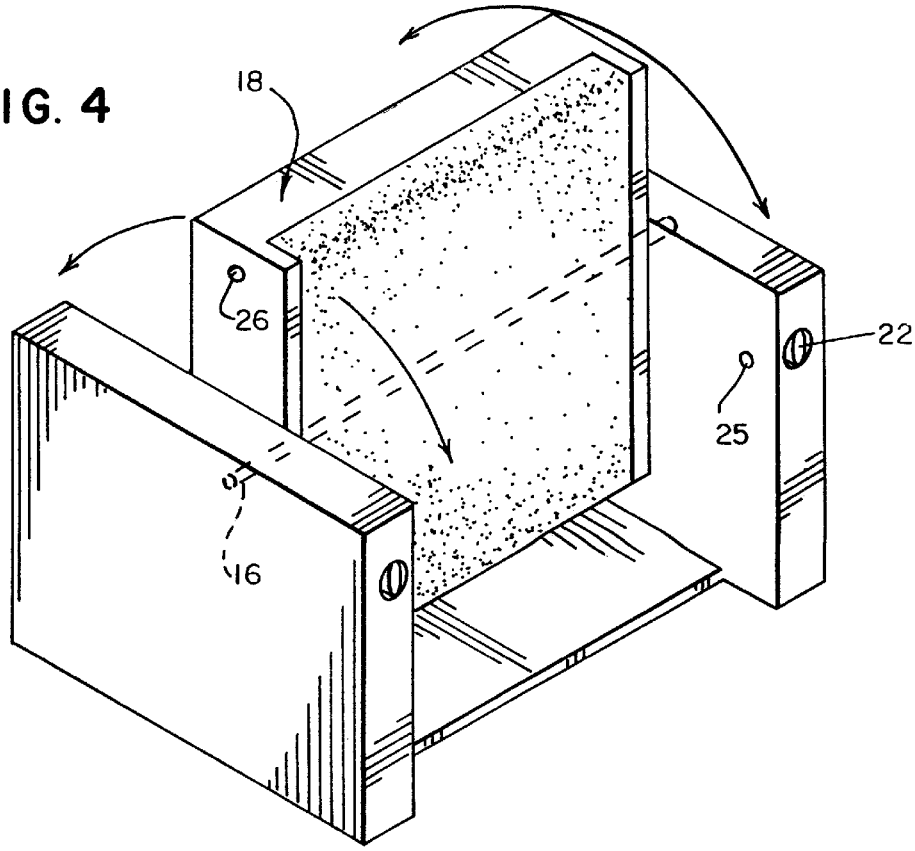
FIG. 4 is a view like FIG. 3, showing the table surface being rotated between the foot rest and table top configurations.

A footrest-table convertible article of furniture embodying the invention (FIG. 1) includes two vertical sides 10, 12 interconnected near their bottom edges by a horizontal brace panel 14. The sides are also joined together by a rod 16 (FIG. 4) which extended between the sides, above the panel 14. The rod extends through a rotatable element 18, and acts as a hinge pin. Preferably, the ends of the rod are fixed in holes in the sides by gluing, but other constructions are possible. For example, the ends could be secured in a way that permits the rod to rotate, using pin joints or ball joints.

Figure 2:
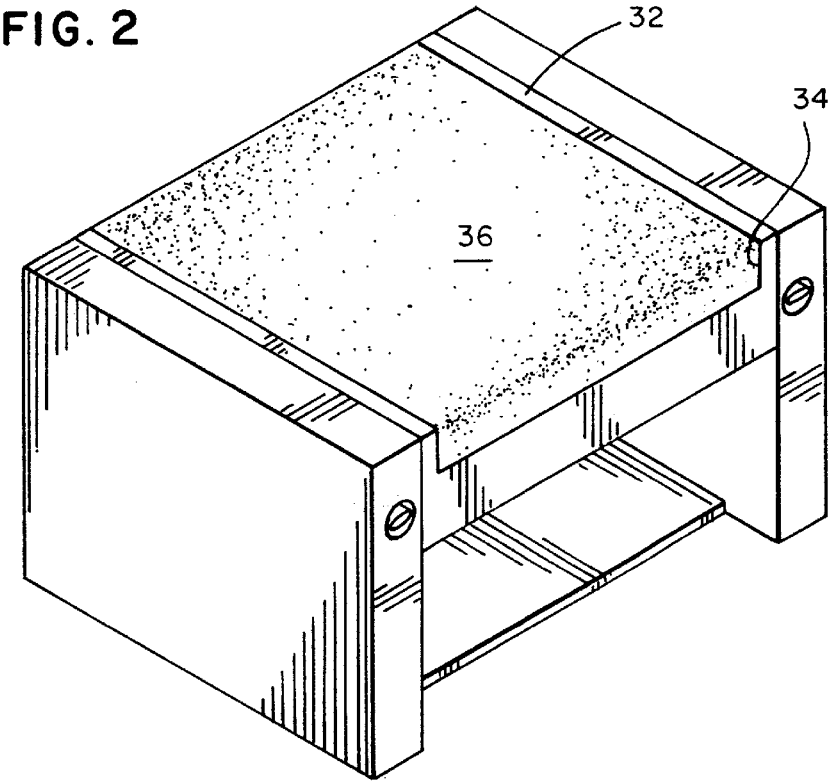
FIG. 2 is a view like FIG. 1, showing the article in its footrest configuration.
Figure 5:
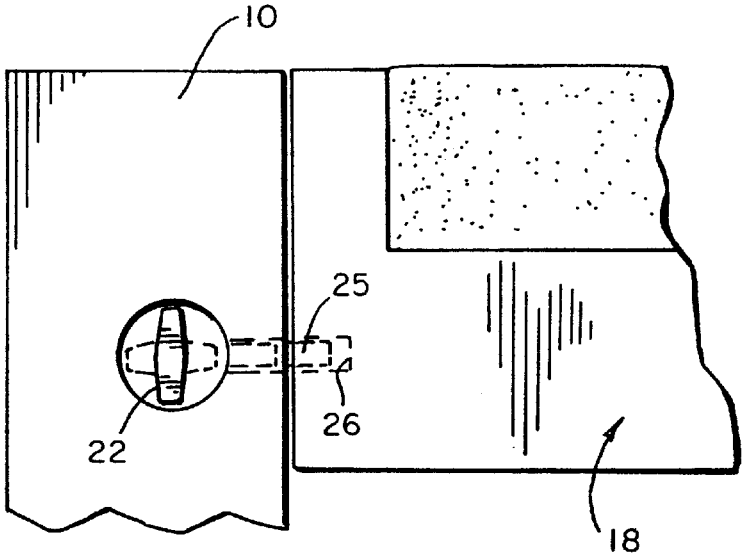
FIG. 5 is a fragmentary front elevation of the article, showing a deadbolt latch for securing the rotatable element.
Figure 6:
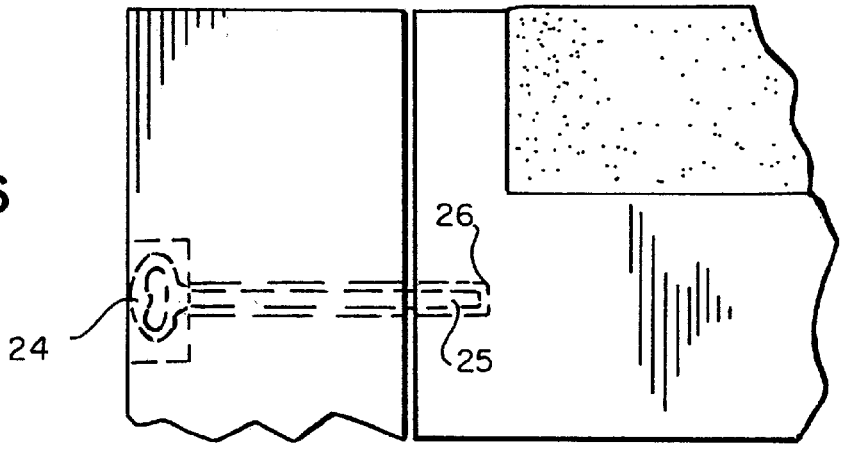
FIG. 6 is a view like FIG. 5, showing an alternative latch comprising a retaining pin.
Figure 7:
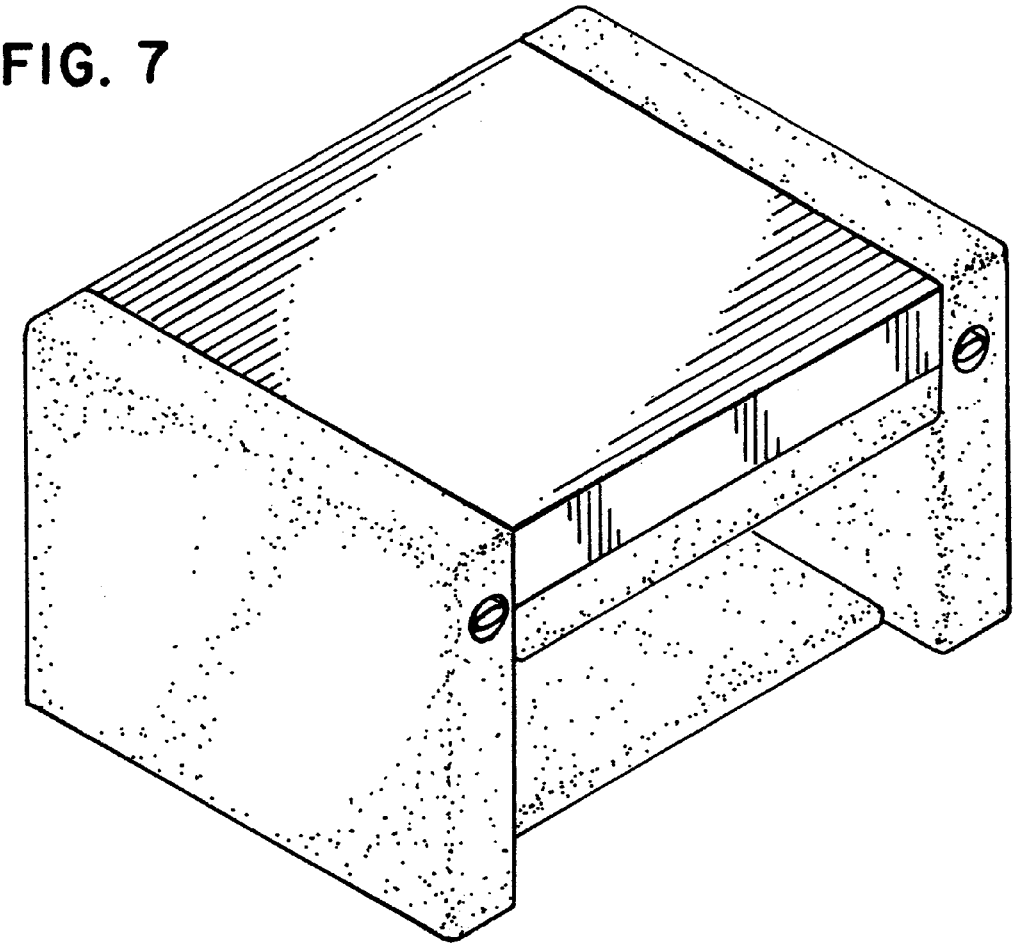
FIG. 7 is a view like FIG. 1, showing a further form of the invention, in which the entire article (except the table top surface) is covered with a fabric so as to resemble an ottoman.

Whatever the form of the pivot connection, the element 18 can be rotated freely about the pivot axis "A". The rotatable element is normally locked in a desired horizontal position by means of one or more locking mechanisms 20. In either such position (FIGS. 1 and 2), the top of the rotatable element 18 is substantially flush with the tops of the side elements 10, 12. Each mechanism, which may be spring loaded toward its deployed position (illustrated in FIGS. 5 and 6) has a manual actuator such as a rotatable handle 22 (FIG. 5) or a pull ring 24 (FIG. 6) operating a bolt 25. The end of the bolt, in either case, seats in a hole 26 in the side of the foot support. Preferably, the sides 28 of the rotatable element, and one major horizontal surface 30 of the support, are made of wood. The opposite major horizontal surface 32 has a recess 34 in which a cushion 36 is seated to provide a comfortable resting place for one's feet.

Figure 3:
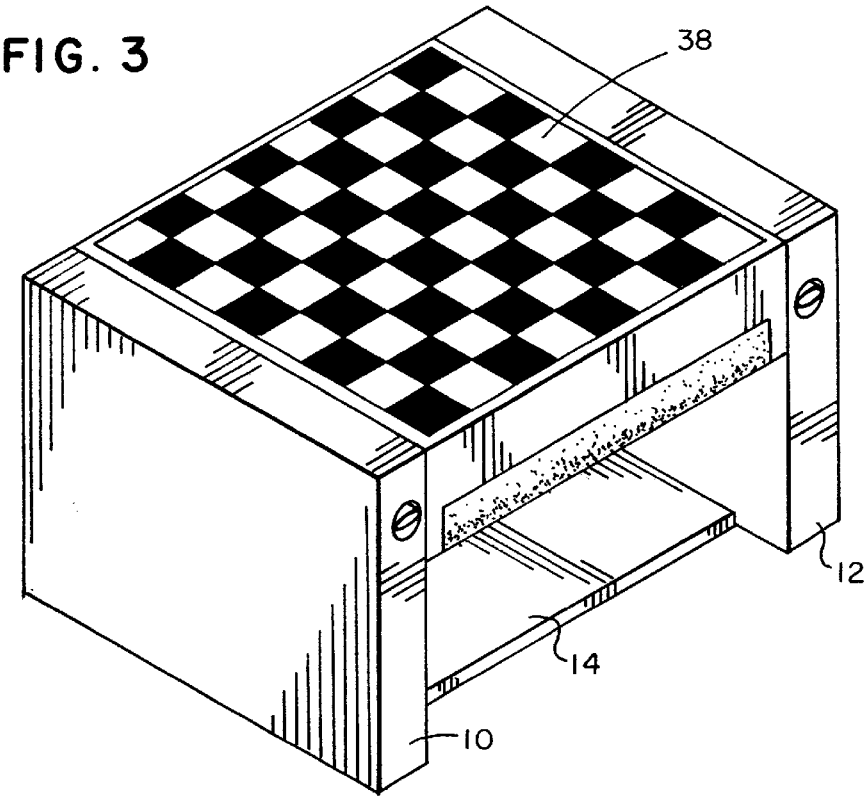
FIG. 3 is a view like FIG. 1, of an alternate form of the invention, where the table top has been designed as a gaming surface.

The table top surface 30 is flat and may be imprinted, inlaid or painted, for example with a game board, such as the chess board 38 illustrated in FIG. 3. Or it may be left plain, as in FIG. 1.

Although the embodiments described above are single units, I contemplate that two or more such units may be placed side by side to provide the effect of a full coffee table. An alternative would be to extend the length of the article to that of a full coffee table, and to have two independently rotatable elements adjacent one another. These alternatives allow for either: (a) a full length coffee table having a flat surface, (b) a unit having half cushioned footrest, half table surface simultaneously; or (c) a dual cushioned footrest for use by people seated sided by side.

The design of the invention facilitates replacement or reupholstery of the cushioned element, for example to match other furniture in the room. The recess 34 in the surface 32 (see FIGS. 1 and 2) can hold a cushion securely, using any one of a number of attachments such as hook and loop fasteners strips ("Velcro"), removable screws, or other fasteners (not shown).

Since the invention is subject to modifications and variations, it is intended that the foregoing description and the accompanying drawings shall be interpreted as only illustrative of the invention defined by the following claims.

I claim:

1. An article of furniture comprising a pair of vertical supports, each being substantially a rectangular prism, at least one brace rigidly interconnecting the vertical supports, a rotatable element disposed between the vertical supports, said rotatable element having the shape of a rectangular prism, and a pivot connection supporting the rotatable element on the vertical supports for rotation about a horizontal axis, said rotatable element having two opposed major surfaces, one being a flat unupholstered table top, and another being a cushioned footrest, said rotatable element being capable of 180° rotation about said axis between a first position in which the table top is uppermost and horizontal, and a second position in which the cushioned footrest is uppermost and horizontal, and a locking mechanism for securing the rotatable element in either of said positions, and wherein said opposed major surfaces are parallel to and equidistant from said axis, so that the article has the same height, whichever major surface is uppermost.

2. The invention of claim 1, wherein said brace is a horizontal panel extending between said vertical supports below said rotatable element.

3. The invention of claim 1, wherein said vertical elements are upholstered.

4. The invention of claim 1, wherein said footrest surface is upholstered.

5. The invention of claim 1, wherein the table top is marked so as to form a game board.

6. The invention of claim 1, wherein said locking mechanism comprises a dead bolt mechanism mounted in one of said vertical elements.

7. The invention of claim 1, wherein said locking mechanism comprises a spring-loaded latch pin mounted in one of said vertical elements.

8. The invention of claim 1, wherein the uppermost surface of the rotatable element is substantially flush with top surfaces of said vertical supports, whichever of said first and second positions the rotatable element is in.

* * * * *